US005164583A

United States Patent [19]

Aichinger et al.

[11] Patent Number: 5,164,583

[45] Date of Patent: Nov. 17, 1992

[54] MATRIX OF IMAGE BRIGHTNESS DETECTOR'S ELEMENTS FORMED BY DIFFERENT GROUPS OF DIFFERENT SHAPE OR SIZE

[75] Inventors: Horst Aichinger, Fuerth; Udo Heinze, Igensdorf, both of Fed. Rep. of Germany

[73] Assignee: Siemens Aktiengesellschaft, Munich, Fed. Rep. of Germany

[21] Appl. No.: 754,073

[22] Filed: Sep. 3, 1991

[30] Foreign Application Priority Data

Oct. 12, 1990 [EP] European Pat. Off. ..... 90119637.8

[51] Int. Cl.[5] ..... H01J 40/14

[52] U.S. Cl. ..... 250/214 VT; 378/99; 358/111

[58] Field of Search ..... 250/213 VT, 213 R, 208.1; 378/99, 108, 95; 358/111

[56] References Cited

U.S. PATENT DOCUMENTS 4,414,682 11/1983 Annis et al. ..... 378/146
4,517,594 5/1985 Horbaschek ..... 358/111
4,639,943 1/1987 Heinze et al. ..... 358/111
4,809,309 2/1989 Beekmans ..... 378/99
4,891,844 1/1990 Riri ..... 358/111
4,982,418 1/1991 Kuehnel ..... 378/95
5,029,338 7/1991 Aichinger et al. ..... 378/99

FOREIGN PATENT DOCUMENTS 3825703 2/1990 Fed. Rep. of Germany .

OTHER PUBLICATIONS

"A Photodiode Array X-ray Imaging Syste, For Digital Angiography," Cunningham et al. Med. Phys. vol. 11 No. 3 May/Jun. 1984, pp. 303-309.

*Primary Examiner*—David C. Nelms
*Assistant Examiner*—Que T. Le
*Attorney, Agent, or Firm*—Hill, Van Santen, Steadman & Simpson

[57] ABSTRACT

A detector for the image brightness which is present at the output screen of an x-ray image intensifier is formed by a combination of individual detector elements, the detector elements having different shapes and/or sizes. The detector elements in combination form a matrix which enables an optimum selection of a desired measurement field by selecting defined combinations of individual detector elements.

14 Claims, 2 Drawing Sheets

MATRIX OF IMAGE BRIGHTNESS DETECTOR'S ELEMENTS FORMED BY DIFFERENT GROUPS OF DIFFERENT SHAPE OR SIZE

BACKGROUND OF THE INVENTION

1. Field of the Invention

The present invention is directed to a detector for the image brightness on the output screen of an x-ray image intensifier, and in particular to such a detector formed by a matrix of detector elements.

2. Description of the Prior Art

Detectors which are formed by a matrix of individual detector elements are known in the art and are used to detect the image brightness which is present at the output screen of an x-ray image intensifier in x-ray diagnostic systems. A detector of this type permits the detector elements to be selected in groups so that a desired measurement field, which can be used to acquire the actual value of the radiation dose rate, is formed. Compared to the use of a photomultiplier as a detector for this purpose, a significantly larger number of different measurement fields are available for selection in a matrix-type detector. Selection of different sizes and shapes of measurement fields is desirable, for example, to match the size and shape of a measurement field to the particular organ under examination for medical diagnostic purposes.

In a known matrix-type detector as disclosed in U.S. Pat. No. 5,029,338, the detector elements are all of the same size and shape, i.e., they are all identically fashioned. Because of the identical fashioning of all of the individual detector elements, not all measurement fields which may be desired in practice can not be selected with this known detector.

SUMMARY OF THE INVENTION

It is an object of the present invention to provide a detector for the image brightness of the output screen of an x-ray image intensifier which achieves a wider variety in the shapes and sizes of measurement fields which can be selected to permit the selection of the size and shape of the measurement field to be optimally adapted to the examination subject.

It is a further object of the present invention to provide such a detector wherein the size and shape of the measurement field can be optimally adapted to an organ under examination in medical diagnostics.

The above objects are achieved in accordance with the principles of the present invention in a detector for the image brightness on the output screen of an x-ray image intensifier, the detector being formed by a matrix of individual detector elements of different shapes and/or sizes. In such a detector constructed in accordance with the principles of the present invention, it is possible to achieve quadratic, rectangular and other polygonal measurements fields, as needed.

In a preferred embodiment of the invention, the detector elements which are grouped around the center of the detector matrix are triangular, so that a polygonal, central measurement field having no right angles is selectable. This measurement field is well-approximated to a circular measurement field, which is desirable for some applications. In a further embodiment of the invention, the detector is seated on a terminal plate which carries integrated circuits for the detector elements on its reverse side. The detector matrix itself as well as the allocated circuits, such as integrated switches for selecting the detector elements, plus amplifiers, can thereby be applied on a single terminal plate. The terminal plate can be movably mounted in a housing, so that adjustment of the position of the terminal plate is possible. A cable for providing electrical connections to the exterior of the housing can be conducted out of the housing.

DESCRIPTION OF THE PREFERRED EMBODIMENTS

Figure 1:
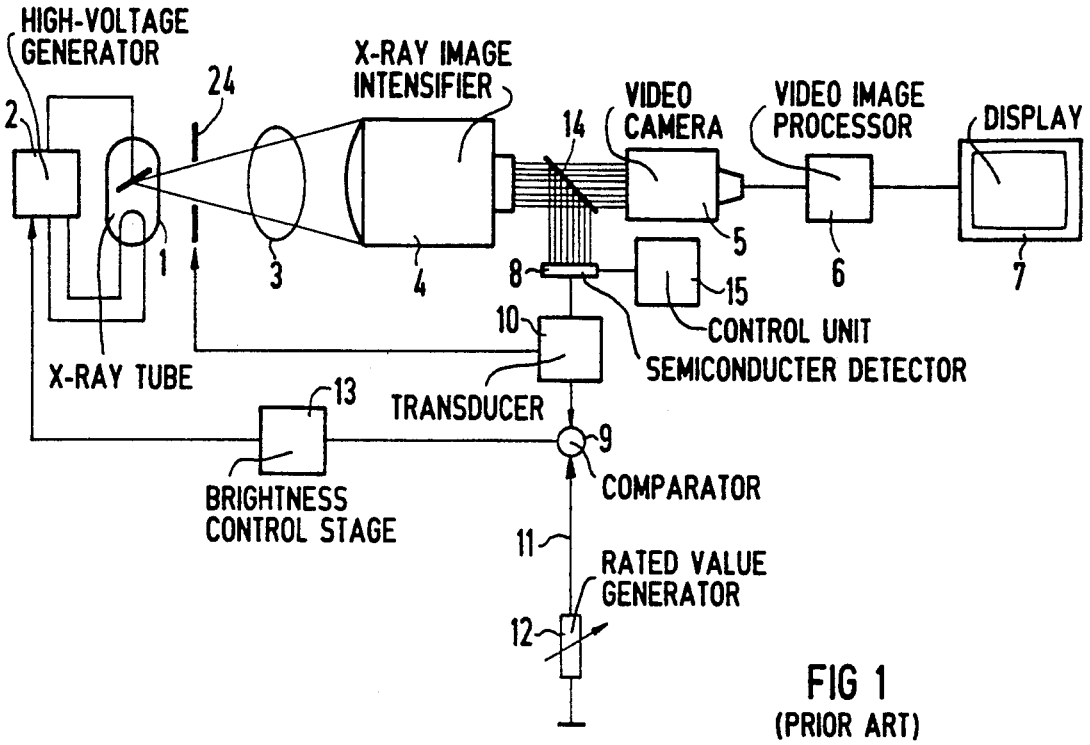
FIG 1 (PRIOR ART)
FIG. 1 is a schematic block diagram of a conventional x-ray diagnostics installation, of the type in which the detector disclosed herein can be employed.

A conventional x-ray diagnostics system, of the type in which the detector disclosed herein can be employed, is shown in FIG. 1. The system includes an x-ray tube 1 which is fed by a high-voltage generator 2. A patient 3 is penetrated by x-radiation generated by the x-ray tube 1. X-radiation which is attenuated by the patient 3 is incident on the input screen of an x-ray image intensifier 4. The x-ray image intensifier 4 converts the intensity distribution of the x-ray image into a visible image having a high luminance at its output screen. This visible image is registered by a video camera 5 and is portrayed on a display 7 via a video image processor 6.

To maintain an average image brightness at a constant value, or to maintain the peak value of individual segments of the image in selected regions at a constant value, a semiconductor detector 8 is provided which functions as an actual value generator. The semiconductor detector 8 supplies a signal to an actual value input of a comparator 9 via a transducer 10. The comparator 9 has a rated (desired) value input 11 to which a signal corresponding to a desired value of the average image brightness in the measurement field of the output screen of the x-ray image intensifier 4 is supplied. Depending on the difference between the actual value and the desired value, the high-voltage generator 2 is influenced by a brightness control stage 13 so that the actual value is matched to the desired value. The desired or rated value is supplied by a rated value generator 12, which is adjustable so that desired value can be set as needed.

The semiconductor detector 8 has a surface onto which the entire output image of the x-ray image intensifier 4, or a portion thereof (by varying the focal length of the optics) can be imaged. This takes place via a partially transmissive mirror 14 disposed in the beam path between the output luminescent screen of the x-ray image intensifier 4 and the video camera 5. A control unit 15 selects a region, or a plurality of regions, of the semiconductor detector 8 electronically in accord with the desired measurement field. The semiconductor detector 8 thereby permits the selection of a number of different measurement fields, which can vary in position as well as in shape and size.

Figure 2:
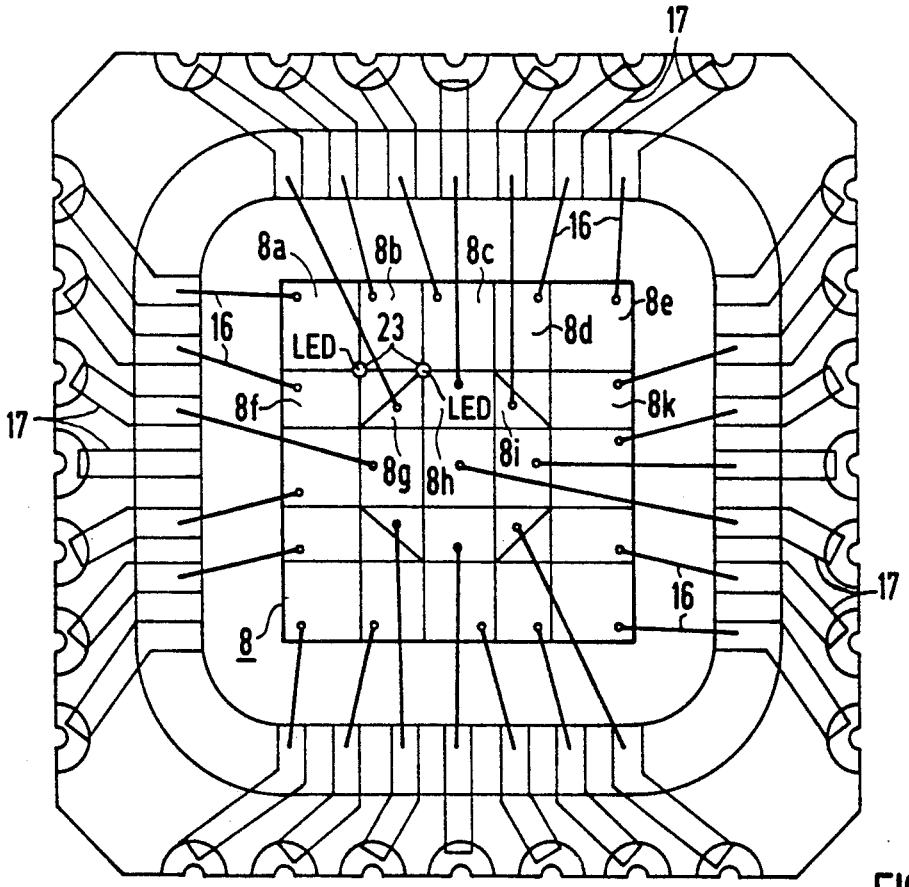
FIG. 2 is a plan view of a detector for the image brightness on the output of an x-ray image intensifier, constructed in accordance with the principles of the present invention.

An enlarged plan view of an exemplary embodiment of a semiconductor detector 8 is shown in FIG. 2, constructed in accordance with the principles of the present invention. This semiconductor detector 8 consists of a matrix of photodiode elements 8*a*, 8*b*, etc. which are connected to terminals 17 via wires 16. The photodiode elements 8*a*, 8*b*, etc., have different shapes and sizes, as can be seen in FIG. 2. For example, the photodiode elements 8*a* and 8*e* have the same shape and size, as do photodiode elements 8*b* and 8*d*, and 8*g* and 8*i*. The photodiode elements 8*a* and 8*e* are selected to have a larger size than the photodiode elements 8*b*, 8*c* and 8*d*. The photodiode elements 8*g* and 8*i* (as well as other unnumbered photodiode elements) are triangular.

Figure 3:
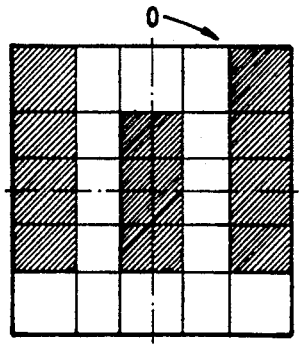
FIGS. 3 through 7 respectively show plan views of various shapes of measurement fields which can be achieved with the detector of FIG. 2.
Figure 4:
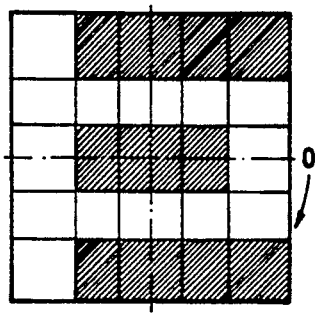
Figure 5:
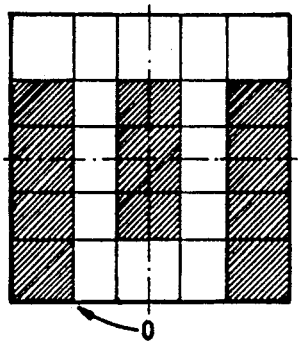
Figure 6:
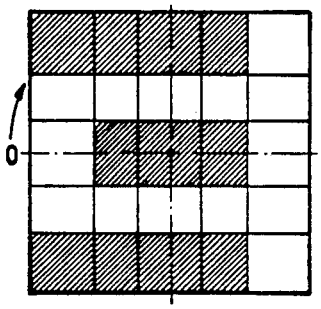

The photodiode elements 8*a*, 8*b*, etc., can be individually selected for forming a desired measurement field. Various types of selectable fields are shown in FIGS. 3 through 7, with the selected photodiode elements being shown darkened. The example for such a selection shown in FIG. 3 is suitable for a colon overview exposure. The selected measurement field must also be oriented dependent on the orientation of the x-ray image with respect to the semiconductor detector 8. Accordingly, as shown in FIGS. 4 through 6, the individual photodiode elements can be selected to maintain the same configuration as in FIG. 3, but in respectively different orientations as shown by the orientation reference o, and the curved arrows. In FIGS. 4 through 6, the measurement field has been electronically rotated by a corresponding selection of the photodiode elements 8*a*, 8*b*, etc., in 90° steps.

Figure 7:
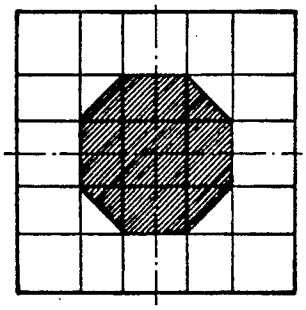

A central measurement field is shown in FIG. 7 which approximates a circular measurement field, which is obtained by the use of triangular photodiode elements 8*g*, 8*i*, etc. This type of measurement field is suitable, for example, for heart and cranium exposures.

Further measurement fields having different shapes and sizes can be selected on the basis of an appropriate combination of the photodiode elements 8*a*, 8*b*, etc.

Figure 8:
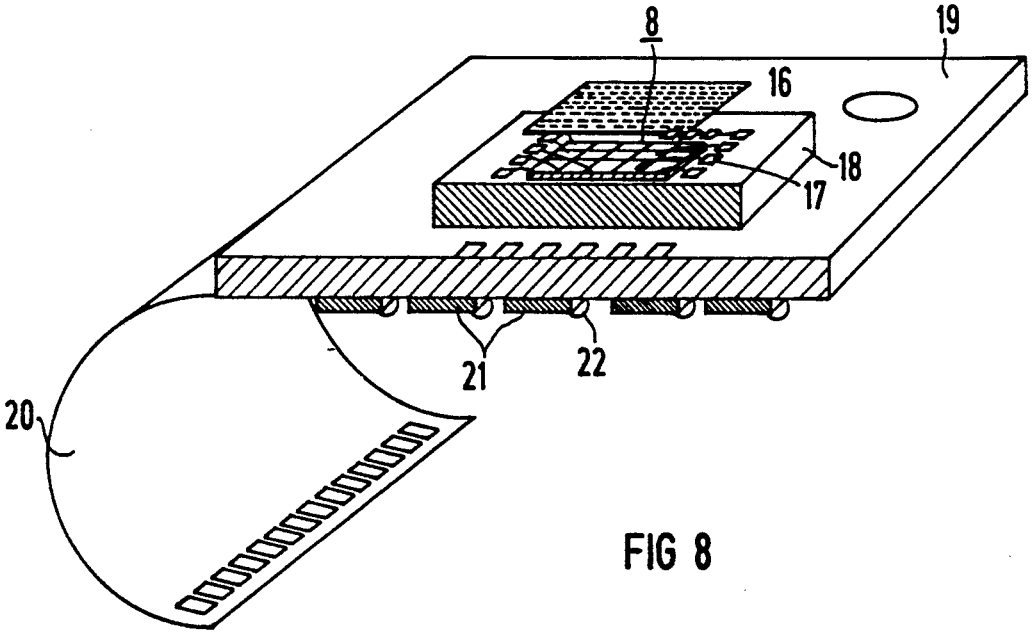
FIG. 8 is a perspective view showing the detector of FIG. 2 in combination with allocated circuits.

The semiconductor detector 8 is shown in FIG. 8 with the terminals 17 being arranged on a substrate 18. The substrate 18 is arranged on a terminal plate 19, which is provided with a flexible printed circuit board 20. Integrated circuits 21 are arranged on a reverse side of the terminal plate 19. The integrated circuits 21 are connected to each other, to the terminals 17, and to the flexible printed circuit board 20 by various wires 22. The integrated circuits 21 contain switches for selecting the photodiode elements 8*a*, 8*b*, etc., and also contain amplifiers.

As shown in FIG. 8, the arrangement of all of these components on the terminal plate 19 results in a particularly compact structure.

As is apparent from FIG. 2, the photodiode elements 8*a*, 8*b*, etc., can be given different sizes by arranging the elements in columns and rows of the matrix having respectively different widths and heights. The different shapes are achieved by subdividing the photodiode elements, for example to form the triangular photodiode elements 8*g*, 8*i*, etc. The triangular photodiode elements 8*g*, 8*i*, etc., as noted above, enable the selection of a central measurement field in form of a polygon without right angles.

It also possible to individually evaluate the signals from the selected photodiode elements 8*a*, 8*b*, etc., and to compare the individual measured values to each other, taking the different sizes of the photodiode elements into consideration. This can be done, for example, for the purpose of automatically disenabling photodiode elements of a selected measurement field, or to leave photodiode elements of the selected measurement field out of consideration in the formation of the actual value measurement, which receive direct radiation and would thus falsify the measurement. As a result of the individual evaluation of the signals of all photodiode elements 8*a*, 8*b*, etc. (i.e., those which were not selected as well), direct radiation can be detected and can be diminished or completely eliminated by a corresponding control of a primary radiation diaphragm 24, connected to and controlled by the transducer 10.

The semiconductor detector 8 can be employed instead of an ionization chamber for determining the direct exposure. In this case, the semiconductor detector 8 will effect an automatic disconnection of the x-ray tube 1 from the high-voltage generator 2 when a predetermined dose has been reached. Moreover, an optimum selection of the measurement field, which determines the dose, is possible.

As shown in FIG. 2, light-emitting diodes 23 are provided at the intersections of the photodiode elements 8*a*, 8*b*, etc. Only two such light-emitting diodes 23 are shown in FIG. 2, however, it will be understood that such light-emitting diodes can be provided at all intersections. These light-emitting diodes are selected by the control unit 15, and optically mark the selected measurement field. The light emitted by the light-emitting diodes 23 is registered by the video camera 5, so that the selected measurement field is optically portrayed within the x-ray image on the display 7.

The signals of each of the photodiode elements 8*a*, 8*b*, etc. can be simultaneously evaluated. To that end, the arithmetic average, or the peak value, of these signals can be optionally formed. A weighting of these signals can also be undertaken dependent on the particular organ under examination.

The light-insensitive regions between the photodiode elements 8*a*, 8*b*, etc., shown simply in the form of lines in FIG. 2, can be provided with a metallization which, upon illumination, makes the boundaries of the photodiode elements 8*a*, 8*b*, etc., and thus the actual position of the semiconductor 8, visible on the display 7.

Even though the individual photodiode detector elements 8*a*, 8*b*, etc., have different sizes and shapes, an arbitrarily selected measurement field shape can be rotated in 90° steps if the photodiode elements 8*a*, 8*b*, etc. are arranged rotationally symmetric relative to a center point. Selection of the measurement field thus becomes independent of the built-in position of the detector 8, as well as independent of the patient positioning.

Although modifications and changes may be suggested by those skilled in the art, it is the intention of the inventors to embody within the patent warranted hereon all changes and modifications as reasonably and properly come within the scope of their contribution to the art.

We claim as out invention:

1. A detector for the image brightness of the output screen of an x-ray image intensifier in an x-ray diagnostic system, said detector comprising:

a matrix formed by a plurality of individual detector elements, said individual detector elements being disposed in said matrix in groups with detector elements in different groups having at least one of a different shape or a different size than detector elements in another group; and means for individually selecting said detector elements in desired combinations to define a measurement field of selected shape and size.

2. A detector as claimed in claim 1 including a plurality of detector elements in a group disposed around a center of said matrix, said detector elements in said group being triangular for forming a polygonal, central measurement field without right angles.

3. A detector as claimed in claim 1 wherein said individual detector elements are arranged in said matrix in columns having a width and rows having a height, and wherein the width of at least some of said columns is different than the height of at least some of said rows.

4. A detector as claimed in claim 1 wherein said matrix of individual detector elements is mounted on a terminal plate, and wherein said detector further comprises a plurality of integrated circuits electrically connected to said detector elements on an opposite side of said terminal plate.

5. A detector as claimed in claim 1 further comprising:

a plurality of light-emitting diodes respectively disposed at intersections of said individual detector elements in said matrix, and means for driving said light-emitting diodes for mixing an image of said light-emitting diodes into an x-ray image.

6. A detector as claimed in claim 1 wherein each individual detector element is formed by a photodiode element, and wherein said detector further comprises means for evaluating electrical signals from each of said photodiode elements.

7. A detector as claimed in claim 6 for use in an x-ray diagnostics system having a primary radiation diaphragm, and wherein said detector further comprises means connected to said detector for controlling said primary radiation diaphragm for reducing direct x-radiation.

8. A detector as claimed in claim 6 wherein said means for evaluating is a means for forming the arithmetic average of signals from selected photodiode elements.

9. A detector as claimed in claim 6 wherein said means for evaluating is a means for identifying a peak value of signals from the selected photodiode elements.

10. A detector as claimed in claim 6 wherein said means for evaluating is a means for forming an arithmetic average of signals from a group of photodiode elements.

11. A detector as claimed in claim 6 wherein said means for evaluating is a means for identifying a peak value of signals from a group of photodiode elements.

12. A detector as claimed in claim 6 wherein said means for evaluating includes means for weighting signals from individual photodiode elements dependent on an examination subject.

13. A detector as claimed in claim 1 wherein said individual detector elements are separated by light-insensitive regions covered by a metallization, wherein said detector is for use in generating an image on a display, and wherein said metallization makes the boundaries of said individual detector elements visible on said display.

14. A detector as claimed in claim 1 wherein said individual detector elements are disposed in said matrix rotationally symmetrically around a center point so that an image formed by selected individual detector elements can be rotated in 90° steps relative to said center point.

* * * * *